US006280249B1

(12) United States Patent
Pan

(10) Patent No.: US 6,280,249 B1
(45) Date of Patent: Aug. 28, 2001

(54) CONNECTING ASSEMBLY FOR DECORATIVE LIGHTING NET

(76) Inventor: Wun Fang Pan, No. 123, Lane 99, Pu Din Road, Hsinchu (TW)

( * ) Notice: Subject to any disclaimer, the term of this patent is extended or adjusted under 35 U.S.C. 154(b) by 0 days.

(21) Appl. No.: 09/478,470

(22) Filed: Jan. 6, 2000

(51) Int. Cl.[7] ..... H01R 13/58
(52) U.S. Cl. ..... 439/574; 439/575
(58) Field of Search ..... 439/574, 575; 362/391, 396, 401, 226, 252

(56) References Cited

U.S. PATENT DOCUMENTS 6,019,634 * 2/2000 Tseng ..... 439/574
6,062,711 * 5/2000 Huang ..... 362/391

* cited by examiner

*Primary Examiner*—Brian Sircus
*Assistant Examiner*—Chandrika Prasad
(74) *Attorney, Agent, or Firm*—Rosenberg, Klein & Lee

(57) ABSTRACT

A connecting assembly for a decorative lighting net employing intercrossed electrical wires to connect a plurality of bulb units is provided. The connecting assembly includes a bulb holder having at least one L-shaped beam formed at a side thereof. The connecting assembly also includes a bulb connector coupled to the bulb holder having at least one L-shaped beam oriented in a direction opposing the direction in which the bulb holder's beam is oriented. The bulb connector's beam engages the bulb holder's beam in longitudinally offset manner to block the escape of electrical wire retained within the bulb holder's beam.

1 Claim, 4 Drawing Sheets

CONNECTING ASSEMBLY FOR DECORATIVE LIGHTING NET

BACKGROUND OF THE INVENTION

Conventional decorative lighting net, used popularly in this time, is comprised of several lighting strings with an electrical wire and a plurality of miniature bulb units, wherein the wires are intercrossed and connected with bulb holders. A connecting structure is provided to connect the electrical wire and the bulb unit together to become a net. The known connecting structure is simply an elastic hook mounted on the bulb holder to hook the wire. It can not provide enough connecting strength. The wire will be released from the hook of the bulb holder without difficulty when a sideward force occurs. So the net structure will be destroyed and the decorative effect is thus lost.

In view of the problem, it is a primary object of the invention to provide a connecting structure [type (IV)] of a decorative lighting net, which includes an L-shaped beam formed on a side of a bulb holder and another L-shaped beam formed on a bulb connector at an opposing direction. By use of the two respective beams, the bulb unit provides [a] better connecting strength to hold the electrical wire and overcome the drawback of the prior art.

Now the features and advantages of the invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
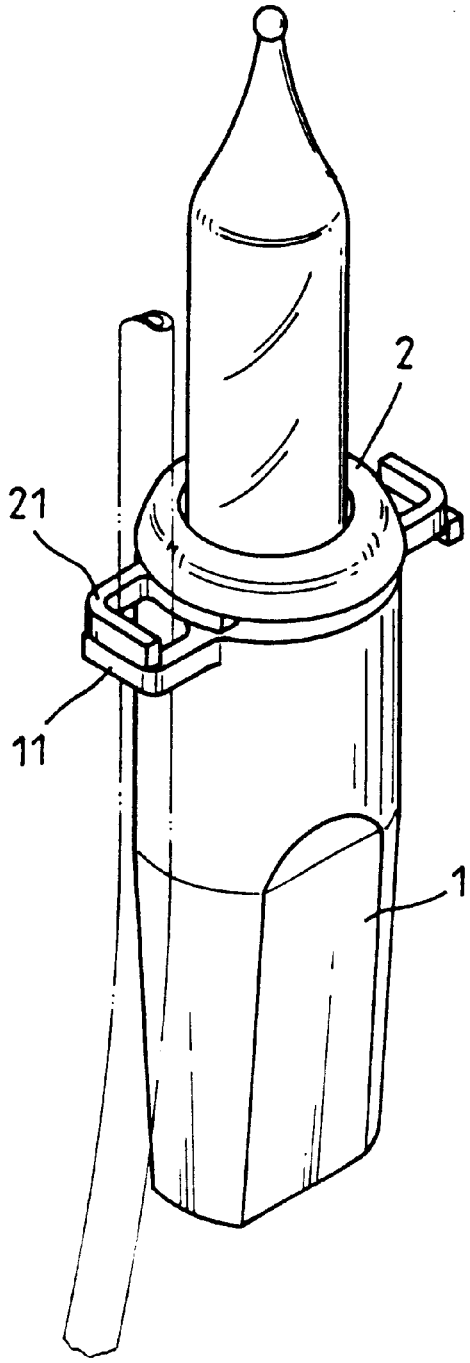
FIG. 1 is a perspective view illustrating the connecting structure of a bulb unit according to the invention.
Figure 2:
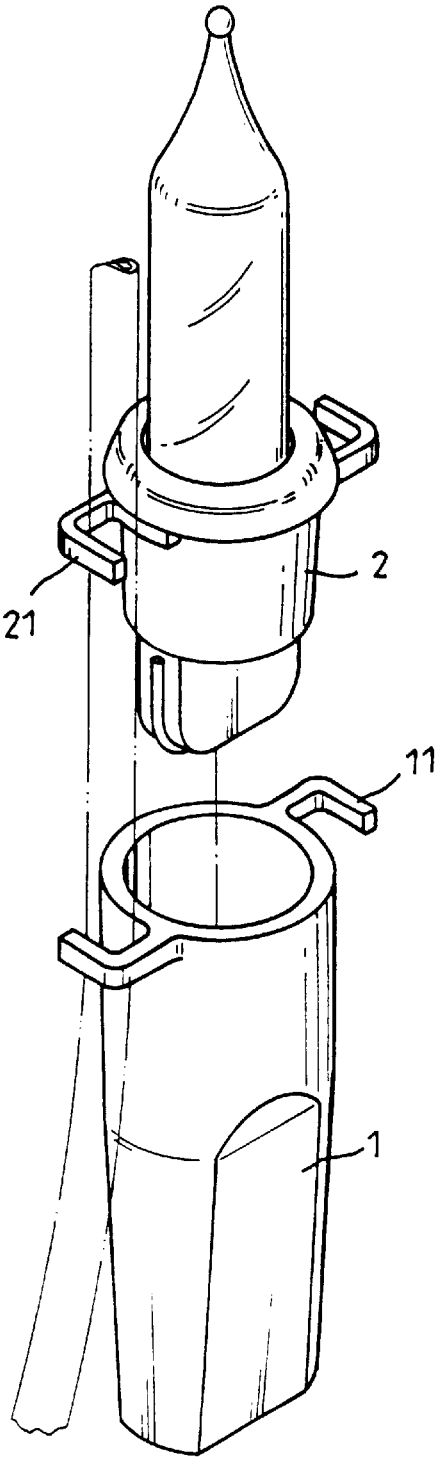
FIG. 2 is an exploded perspective view of FIG. 1.
Figure 3:
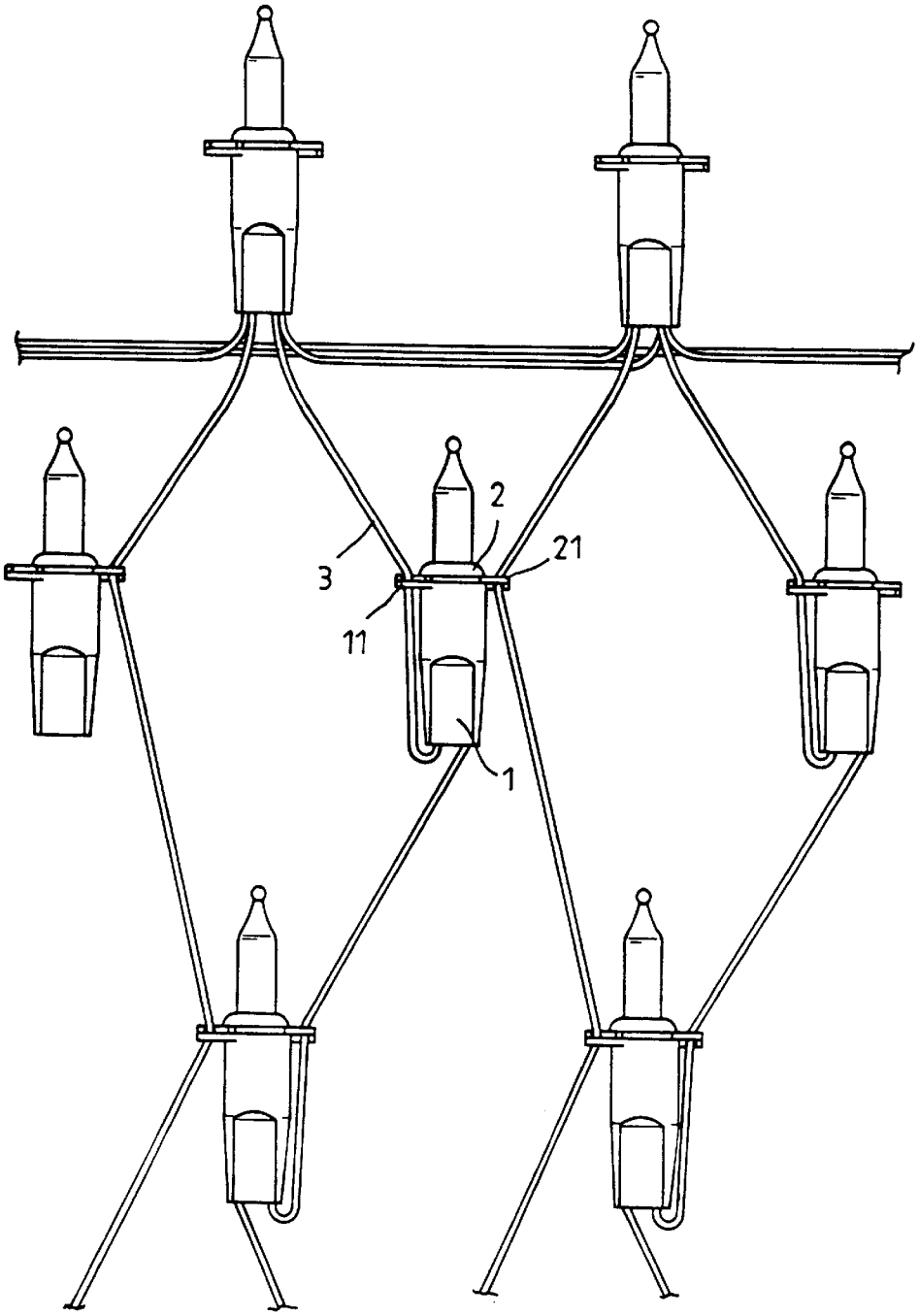
FIG. 3 is a plan view depicting a decorative lighting net according to the present invention.

Referring to FIGS. 1 to 3, the present invention is to provide an improvement on a connecting structure of a decorative lighting net. It can be seen that both sides of the bulb holder (1) are provided with an L-shape beam (11). Both sides of the bulb connector (2) are provided with a respective L-shape beam (21), which is provided at a contrary direction to the beam (11). When the connector (2) is received in the bulb holder (1), the two contrary L-shape beams (11), (21) become a closed space for connecting the electrical wire therein.

After the assembly of the bulb unit, the electrical wire (3) will be connected by two beams (11), (21) and can never be separated from the holder (1). It can be understood that the connection of the electrical wires will be strong enough to keep the wires and the bulb units to become a decorative lighting net, as shown in FIG. 3, to show a perfect lighting effect.

Figure 4:
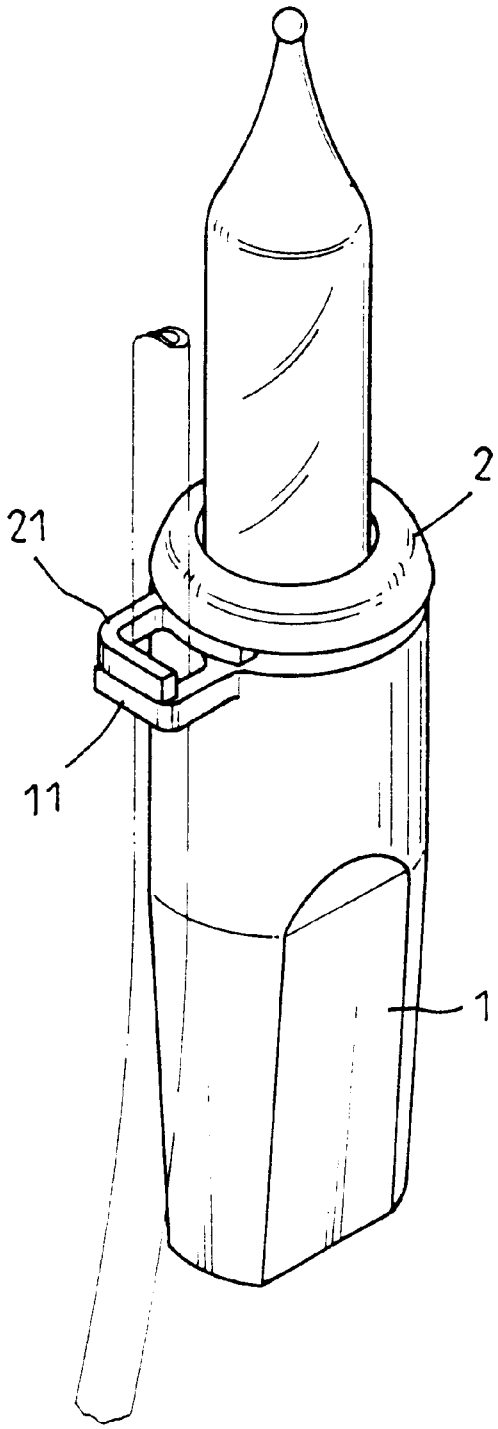
FIG. 4 is a perspective view illustrating another embodiment of the connecting structure of a bulb unit according to the invention.

In FIG. 4, it depicts only a connecting structure is provided for use as a curtain-type decorative lighting string. This embodiment can also obtain a same purpose for utility.

In summary, the present invention provides a decorative lighting net with an invented structure and providing a better connecting effect. It has superiority over prior art net structures obviously and should be allowed for patent.

What is claimed is:

1. A connecting assembly for connecting a bulb unit to at least one electrical wire of a decorative lighting net comprising:

(a) a longitudinally extended bulb holder having at least one L-shaped first beam portion for receiving the electrical wire therein, said first beam portion extending in a direction transverse to the longitudinal direction and oriented in a first lateral direction; and (b) a bulb connector for retaining the bulb unit therein, said bulb connector including (i) at least a portion thereof adapted for insert into an opening of said bulb holder to join said bulb connector to said bulb holder, and (ii) at least one L-shaped second beam portion extending in a direction transverse to the longitudinal direction and oriented in a second lateral direction, said second lateral direction being opposite said first lateral direction, said second beam portion being juxtaposed on said first beam portion when said bulb connector is joined to said bulb holder for forming an enclosed space to capture the electrical wire extending therethrough.

* * * * *